United States Patent [19]

Sugiura et al.

[11] Patent Number: 4,659,210

[45] **Date of Patent: * Apr. 21, 1987**

[54] COPYING APPARATUS

[75] Inventors: Susumu Sugiura, Yamato; Tadashi Sato, Kokubunji, both of Japan

[73] Assignee: Canon Kabushiki Kaisha, Tokyo, Japan

[ * ] Notice: The portion of the term of this patent subsequent to Feb. 16, 1999 has been disclaimed.

[21] Appl. No.: 599,523

[22] Filed: Apr. 12, 1984

Related U.S. Application Data

[63] Continuation of Ser. No. 329,016, Dec. 9, 1981, abandoned.

[30] Foreign Application Priority Data

Apr. 23, 1978 [JP] Japan ..... 53-48004

[51] Int. Cl.[4] ..... G03G 15/00

[52] U.S. Cl. ..... 355/14 R; 355/7; 355/40

[58] Field of Search ..... 355/3 R, 7, 14 R, 40, 355/46; 354/3, 5

[56] References Cited

U.S. PATENT DOCUMENTS

| | | | |
|---|---|---|---|
| 3,660,818 | 5/1972 | Amodei et al. | 355/3 R X |
| 3,824,604 | 7/1974 | Stein | 355/3 R X |
| 4,026,642 | 5/1977 | Tanaka et al. | 355/3 R X |
| 4,080,058 | 3/1978 | Stephany et al. | 355/3 R X |
| 4,082,443 | 4/1978 | Draugelis et al. | 355/14 R X |
| 4,094,606 | 6/1978 | Camphausen | 355/3 R |
| 4,110,794 | 8/1978 | Lester et al. | 354/5 X |
| 4,315,684 | 2/1982 | Sugiura et al. | 355/14 R |

*Primary Examiner*—Fred L. Braun

*Attorney, Agent, or Firm*—Fitzpatrick, Cella, Harper & Scinto

[57] ABSTRACT

An image forming apparatus wherein an image material is exposed and read by a line-configured photosensor. The line readings by the photosensor are converted into electrical signals which are put out in serial form. In one embodiment the image material is moved at a predetermined speed for scanning wherein the exposure and photosensor devices are fixed. Also, the photosensor may have a width which is the same as the image width of the image material, and these features permit accurate readings even from reduced size image material. In another embodiment a register is provided to permit a presetting of the number of lines to be read.

6 Claims, 22 Drawing Figures

COPYING APPARATUS

This is a continuation of application Ser. No. 329,016, filed Dec. 9, 1981 now abandoned.

BACKGROUND OF THE INVENTION

1. Field of the Invention

This invention relates to an automatic document treating method and apparatus in an electrophotographic copying machine. More particularly; it relates to a copying machine having an electronic sorter function. See U.S. Pat. Nos. 4,054,380 and 3,829,083.

Along with the recent tendency of PPC copying machines toward compactness, high speed and multifunction, automatic document treating devices have come into wide use which not only enable production of the same copies of an original document but also have the automatic book-binding function such as automatic document feeder (hereinafter referred to as ADF) and automatic page arrangement (hereinafter referred to as sorter).

2. Description of the Prior Art

Most of the conventional copying machines are of the type as shown in FIGS. 1 and 2 of the accompanying drawings in which an electrophotographic copying machine 8 is additionally provided with an ADF mechanism.

Briefly describing FIG. 1, a lowermost one of sheet originals is fed from a tray 2 containing therein a stock of sheet originals 1 by a roller 3 through a transport belt 4 onto an original carriage 5. After the fed original is fixedly set on the original carriage, the copying operation is effected through the well-known process of the electrophotographic copying machine wherein the optical system is reciprocated and the original is subjected to the slit exposure. After the completion of the copying, the original is transported by the now reversely moving transport belt 4 and discharged into a discharge tray 7 by a pawl 6. Thereafter, by repeating the same operation, a volume of printed matters having pages arranged in good order may be automatically prepared. However, in order to prepare a second volume of copies, the originals in the tray 7 must be manually returned into the tray 2 and this means complexity of handling of the originals and moreover, the operator must stay with the copying machine throughout the copying operation.

In the apparatus of FIG. 2, a lowermost one of sheet originals is fed from a tray 8 to a first transport roller 10 by a roller 9 and transported onto an original carriage by rollers 11 and 12 and fixedly set thereon. The copying operation is effected with that original being illuminated. After the completion of the copying, the roller 12 is operated to discharge the original from the original carriage, and the original is again set in the tray 8 by a roller 13. By repeating the same operation, a plurality of volumes of printed matters having pages well arranged are prepared.

However, where the number of volumes to be bound is great, the frequency with which the originals are set on the original carriage and discharged therefrom is also great and so, there are dangers of the precious originals being injured. There are also dangers that the originals are transported in overlapped condition and accordingly, a volume of copies having missing pages may be prepared.

There is another system whereby a necessary number of copies are obtained from one original and those copies are sorted into a necessary number of volumes by a sorter and such operation is repeated by replacing the original with new ones in succession. This system eliminates the need to set the original often and reduces the danger of injuring the originals, but where a great number of volumes are to be bound, the sorter must be on a large scale and this means an increased mechanical space for temporarily storing the copies and moreover, a complicated sorting function.

When considering the operability, the former automatic document feeding system is restricted to sheet originals and cannot use book-type originals. On the other hand, in the latter sorter system, the operator must be attendant on the machine while turning the pages until the book binding is completed. This means waste of much time and labor to the operator.

Thus, even if a combination of the automatic document feeder system and the sorter system is employed, there has been no copying machine which satisfies all of the requirements that it does not injure the originals, that it permits the use of both sheet and book originals and that the operating time of the operator may be reduced.

SUMMARY OF THE INVENTION

It is an object of the present invention to provide a copying method and apparatus having a simple automatic document treating device which eliminates all the above-noted disadvantages.

It is another object of the present invention to provide a copying method and apparatus which enable obtainment of a plurality of volumes of copies having well arranged pages simply by taking the trouble of turning the pages of a book original in a general way.

It is still another object of the present invention to provide a copying method and apparatus which enable automatic obtainment of a plurality of volumes of copies having well arranged pages without the use of a sorter.

It is yet still another object of the present invention to provide a copying method and apparatus which enable automatic obtainment of a plurality of volumes of copies having well arranged pages by giving a copying instruction for a desired number of volumes of copies, irrespective of sheet or book originals, and even if the operator stays away from the copying machine.

It is a further object of the present invention to provide a copying control method and apparatus in which each page of originals is stored in a memory in a general way and the stored information is repetitively read out to enable a plurality of volumes of copies to be automatically obtained.

The invention will become more fully apparent from the following detailed description thereof taken in conjunction with the accompanying drawings.

DESCRIPTION OF THE PREFERRED EMBODIMENTS

Figure 1:
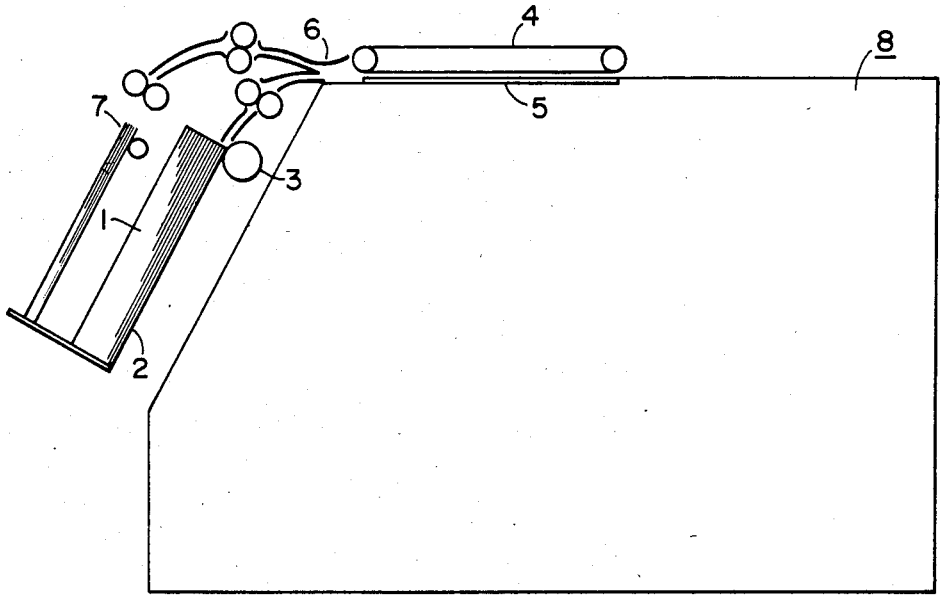
FIG. 1 PRIOR ART
FIGS. 1 and 2 are schematic views of the automatic document treating devices according to the prior art.
Figure 2:
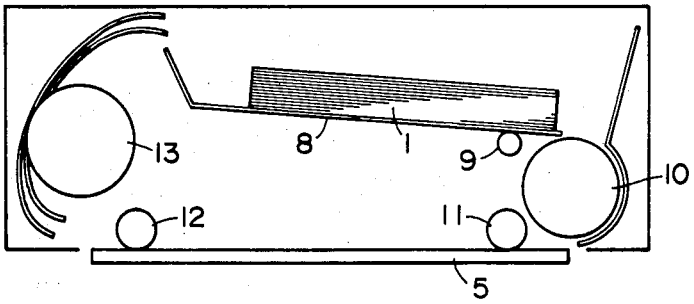
FIG. 2 PRIOR ART
Figure 3:
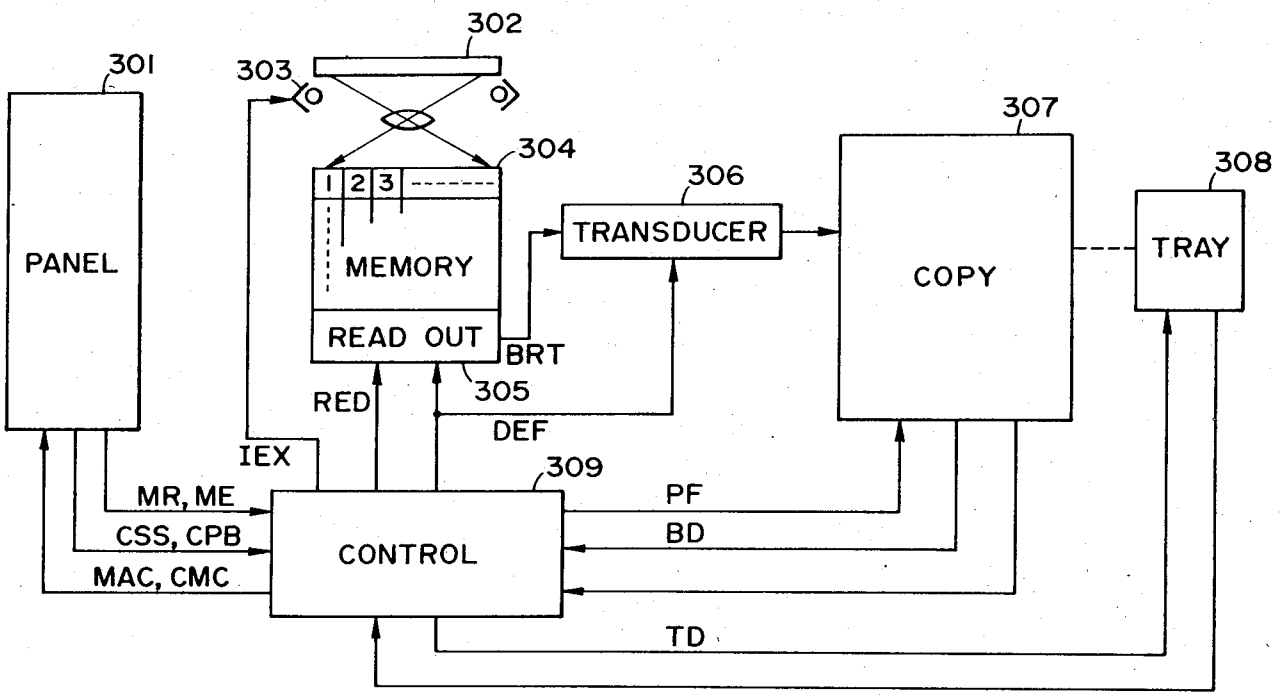
FIG. 3 is a schematic block diagram showing an example of the copying method and apparatus according to the present invention.

Referring to FIG. 3, it is a control block diagram showing an embodiment of the copying apparatus to which the present invention is applied. FIG. 3 includes an operating panel 301 for entering copy start or like instruction and for indicating the number of volumes, an original carriage 302 for supporting thereon originals or articles to be copied, a light source 303 for illuminating the original, and a light image memory 304 for temporarily storing the image of the original using liquid crystal, electrochromy or PLZT (a compound of lead, lanthanum, zirconium and titanium which is fully described in the journal *Television* Vol. 29, No. 8). Designated by 305 is a read-out unit including a photoelectric converter for scanning the image memory 304 and reading out image signals. By this, image signals may be converted into time-serial electrical signals. Denoted by 306 is a transducer for converting the time-serial electrical signals into time-serial light signals. The transducer 306 may comprise, for example, a laser light source and a driver circuit for the light source (including a modulation and deflection circuit). Designated by 308 is a tray for containing copies produced by a copying apparatus 307. When copies of a volume are contained therein, the tray 308 slides at a good time to leave off and puts an end for each volume. Designated by 309 is a control for optimally effecting the above-described operations. MR, ME, CSS and CPB respectively are a signal for causing the memory 304 to start its storing operation, a signal for stopping the storing operation of the memory 304 to make copying possible, a number signal indicative of the number of volumes, and a signal instructing print start. These signals are entered by the key switches of FIG. 6. MAC and CMC respectively are signals for indicating on the panel the number of images stored by the memory 304 and the number of volumes. IEX is a signal for controlling the turn-on of the lamp 303 for causing the memory 304 to store the images. PF is a signal for operating a roller in the copier 307 for feeding paper from a cassette. RED is a signal for controlling the operation of the converter 305. BRT is a signal for intensity-modulating the laser beam. DEF is a signal for deflecting the laser beam. BD is a signal for detecting the arrival of a beam spot at the end of a photosensitive medium and for controlling the read-out from the memory. TD is a signal for slidingly moving the tray 308 which receives paper having images transferred thereto.

Figure 6:
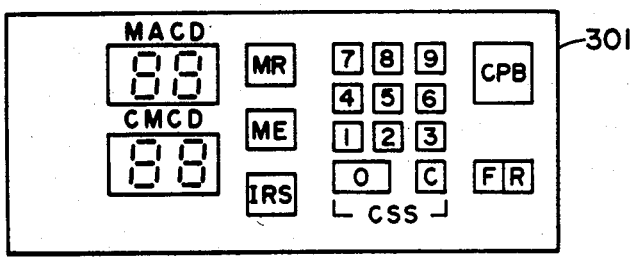
FIG. 6 a top plan view of the operating unit of the copying apparatus shown in FIG. 4.

FIG. 6 shows an example of the operating panel. MR is a read-in switch for writing image information into the memory, ME is a memory end switch for indicating the end of the writing-in, CPB is a read-out record start switch, CSS is a setter for setting the number of recorded volumes through the numeral keys, MAC is an indicator for indicating the stored number of memory areas, and CMCD is an indicator for indicating the set number by the CSS. All these adopt the segment display system.

In the foregoing block diagram, for example, when five copies of page 1 to page 10 of a book original are to be produced and arranged in the order of page numbers, if the memory switch MR on the operating panel 301 (details of which are shown in FIG. 6) is depressed with the first page of the book original supported on the original carriage 302, the first page of the book original is illuminated by the lamp 303 and stored in the area 1 of the image memory 304 (the areas will hereinafter be referred to as pages or segments). Next, if the memory switch MR is again depressed with the second page of the book original supported on the original carriage, the image information of the second page is stored in the memory area 2 of the memory. Likewise, the original images up to the tenth page are stored in the image memory. By the number set key CSS of the panel 301, the number of required volumes is stored in another memory (register). Thereafter, upon turn-on of the start switch CPB, read-out of the image signals from the memory area 1 is started and the light signals so read out are converted into electrical signals, and the time-serial electrical signals are converted into beam signals of the laser light by the transducer 306. The laser light is intensity-modulated. The photosensitive medium of the electrophotographic copying machine is exposed to the resultant modulation beam to form an electrostatic latent image, which is later developed. Thus, the recording of the first page has been effected. After completion of the recording of the first page, the image memory area 2 is read out and the recording of the second page is likewise effected. The recording of up to the tenth page (a volume) is likewise terminated, whereupon, if a further volume is desired, the image memory may be returned to its initial position so that the memory areas 1, 2 and so on may be successively read out, thus accomplishing copying of page 1 to page 10 in the same manner as the first volume.

Figure 7A:
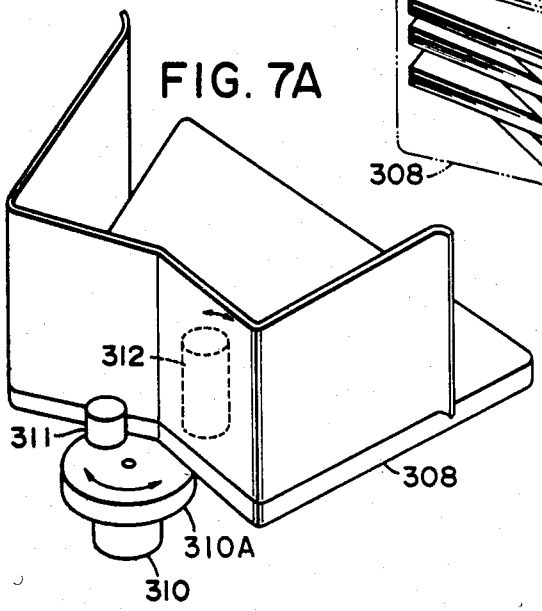
FIGS. 7A and 7B are perspective views showing examples of the tray in the copying apparatus of the present invention.
Figure 7B:
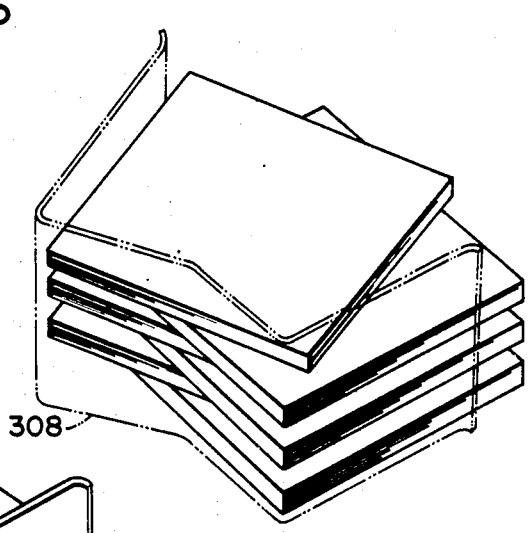

When a volume of print has been completed, means for sliding the tray 308, for example, a reversible motor, operates in response to a tray signal TD from the control 309 to move the tray 308. For example, the tray as shown in FIG. 7A is used. A cam plate 310A is moved to the right or to the left as indicated by the arrow by the reversible motor 310. In accordance with the movement of the cam plate, the tray 308 slides leftward or rightward about a shaft 312 with the aid of a cam 311. FIG. 7B shows six volumes of copies contained in the tray in the manner described above. The signal TD may be generated by detecting that the last paper of each volume has been discharged from the copier.

Figures 4, 5:
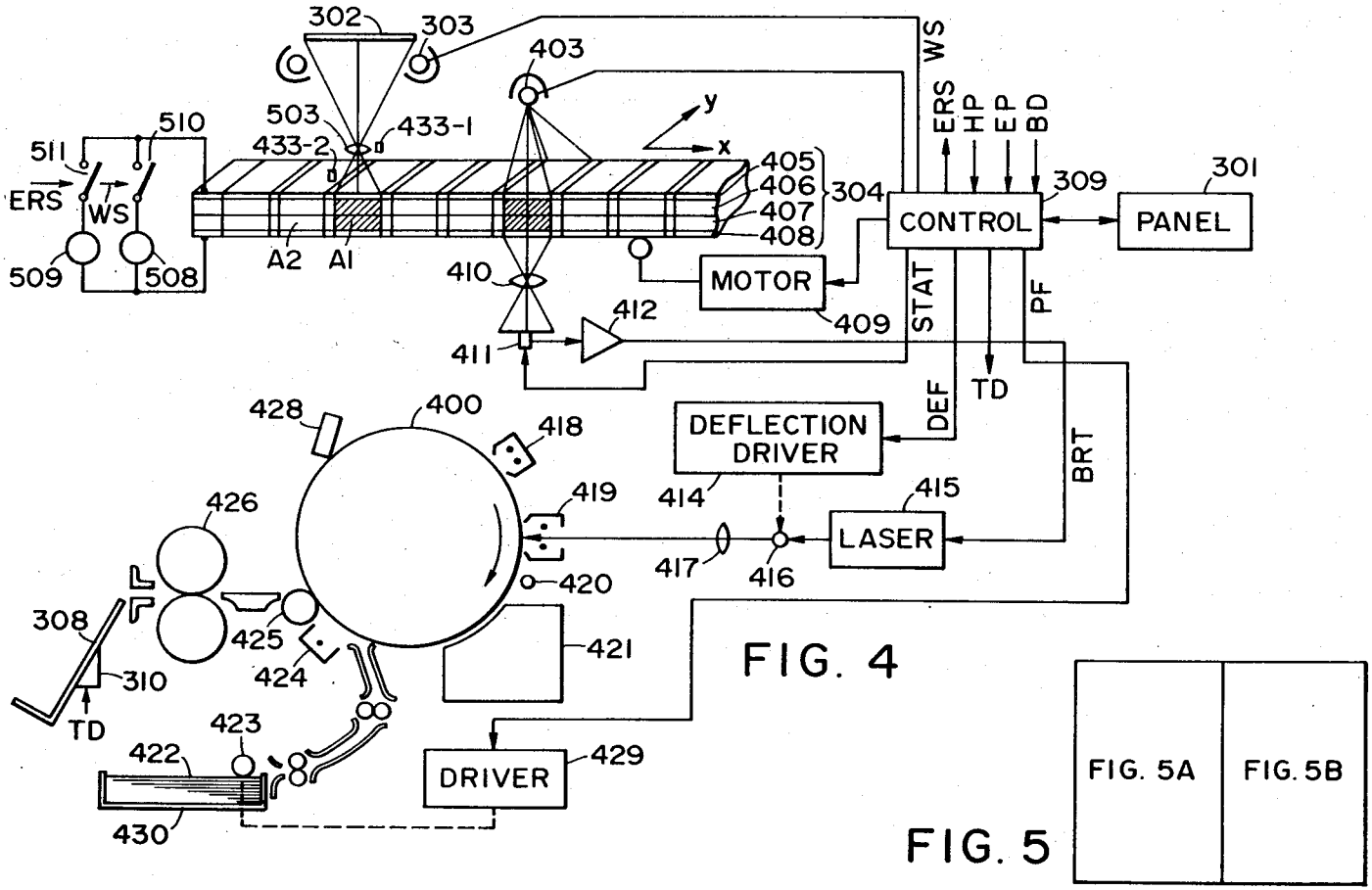
FIG. 4 is a cross-sectional view of an embodiment of the copying apparatus according to the present invention.

An embodiment of the present invention will now be described fully. FIG. 4 is a schematic cross-sectional view of a copying machine using as the memory 304 a complex element including liquid crystal. The copying machine includes an original carriage 302, a light source 303 for illuminating the original, a drum 400 having a photosensitive medium on the peripheral surface thereof, a light source 403 for reading out the original image in the memory, transparent electrodes 405, 408, a photoconductive layer 406, liquid crystal 407, a rectangular planar image memory 405–408 movable in the direction of the x-axis, a pulse motor 409 for effecting the movement of the image memory in the direction of the x-axis, a lens system 410, a photodetector 411 for converting into an electrical signal the stored image formed through the lens 410, a video amplifier 412 for amplifying the output of the photodetector 411, a laser 415, a well-known deflecting mirror 416 for scanning the laser beam in the axial direction of the photosensitive drum 400, a deflection driver 414 for deflecting the laser beam from the laser 415, a well-known F-$\theta$ lens 417 for correcting the light path by scanning, a primary charger 418 for charging the photosensitive drum 400, a charger 419 for AC-charging the drum 400 simultaneously with the exposure to the laser beam, a whole surface exposure lamp 420, a developing device 421, transfer paper 422, a pick-up roller 423 for feeding paper 422 from a container 430, an image transfer charger 424, a roller 426 for fixing transferred image, a tray 308 as described for receiving discharge transfer paper, a blade 428 for cleaning the photosensitive drum 400 to make it ready for reuse, a circuit 429 for driving the pick-up roller 423, and an operating panel 301 as already described. The lamps 303 and 403 operate in response to the write-in signal WS and read-out clear signal from the controller 309. The liquid crystal 407 comprises a mixture of 5% cholesteric liquid crystal and nematic liquid crystal and having an image memory characteristic of the order of two hours. Designated by 508 is a power source for causing the memory 407 to store images. The power source 508 generates a voltage of several volts having a sinusoidal wave or a square wave of a frequency of several kilohertz. Denoted by 509 is a memory clearing power source for generating a voltage of a sinusoidal wave or a square wave of several tens to several hundred kilohertz. The power sources 508 and 509 apply the voltages to the memory through electrodes 405 and 408. Denoted by 510 and 511 are switches for writing in and clearing. These switches are closed in response to the write-in signal WS and the clear signal ERS from the control unit 309. Designated by 433-1 is a switch for detecting the initial position of the memory 304 and stopping the movement of the memory. This switch is closed by optically detecting a mark provided, for example, on the non-image portion of the memory. Denoted by 433-2 is an optical switch for likewise detecting the terminal end of the memory. The detector 411 is a solid state line scanner (self-scanned image sensor) called CCD (Charge Coupled Device). This detector is provided so as to be capable of detecting an image extending by one bit (one image element) in the x-axis direction and by the width of the original in the y-axis direction. The photoconductive layer 406 uses OPC (organic semiconductor photoconductive layer). By this, the transmission of light can be enhanced.

Figure 8:
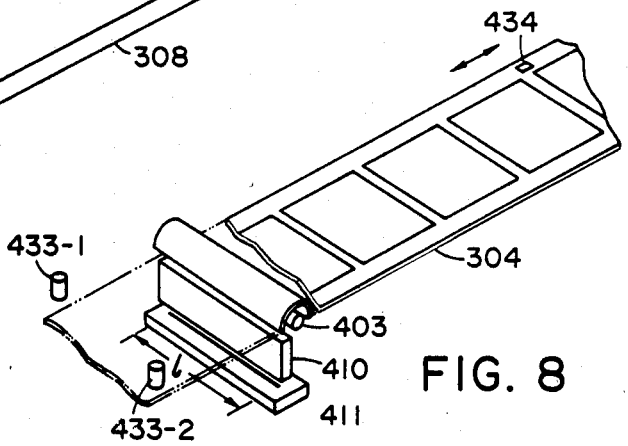
FIG. 8 is a perspective view of the CCD in the copying apparatus of the present invention.

FIG. 8 shows an example of the CCD. In the Figure, l represents the length of the CCD 411. For example, the CCD 121 produced by the Fairchild Semiconductor Corporation has a length l of 26 mm and has 1728 bits in the y-direction. That is, it has 65 bits of image elements per millimeter. Incidentally, 10 bits of image elements per millimeter can be said to have a sufficient resolving power to the human eye, so the image formed on the CCD 411 is reduced to 1/6.5 relative to the original image on the platen 302. On the CCD 411, the width of the stored image of the memory 304 may be formed at 1× magnification through a known optical element array 410. Therefore, since the resolving power of the liquid crystal is more than 40 bits, the CCD can read out the image without hampering the resolving power. Also, since the width of the memory 304 can be 26 mm which is equal to the length l of the CCD, the memory can be made very small. Incidentally, the image portion of an A4 size book original (290 mm×210 mm) is usually 250 mm×170 mm, and therefore, if this is reduced to 1/6.5, the width substantially becomes 26 mm which can be stored in the afore-mentioned memory. Thus, the length of the memory which can store 10 pages of the original is substantially 400 mm with the space as 1 mm.

Figure 9:
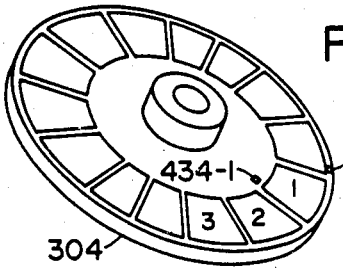
FIG. 9 is a perspective view showing an example of the memory.

If the memory 304 is made into a form of disc 7 as shown in FIG. 9 and memory areas 1, 2, 3 are arranged about the disc, the memory can store multiple pages and can be made compact. Incidentally, a disc of about 300 mm diameter can store 20 pages. Designated by 434-1 on the memory plate is a mark for detecting the initial position of the memory by means of the switch element 433-1, and 434-2 is a mark for detecting the memory end by means of the switch element 433-2.

Figure 10:
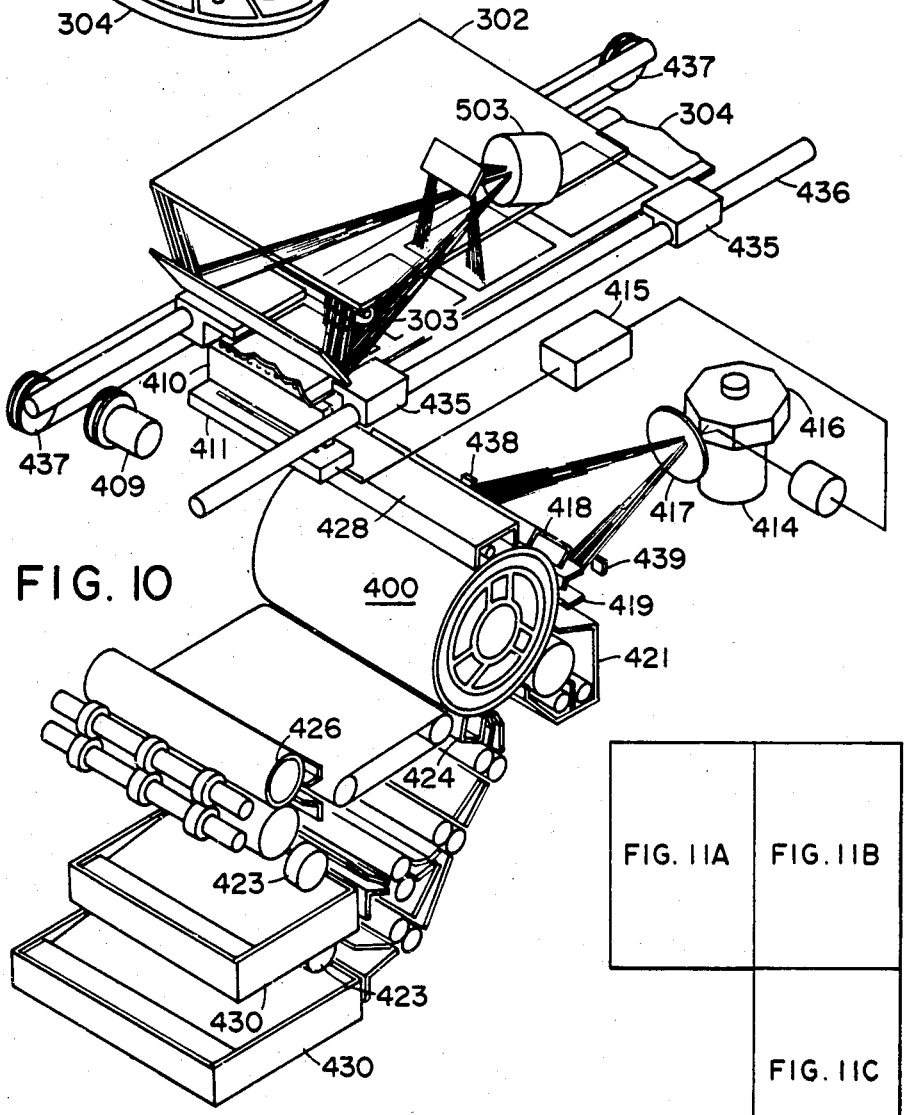
FIG. 10 is a perspective view showing an example of the copying apparatus according to the present invention.

FIG. 10 is a perspective view of an example of the copying apparatus which is equal to the apparatus shown in FIG. 4. A well-known polygon mirror may be used as the deflecting mirror 416 and rotated by a motor 414 so that the photosensitive drum 400 may be scanned with a reflected beam. Denoted by 438 is a beam detector which develops a signal BD (FIG. 3). If the beam detector 439 is provided at the left end of the drum, the error of the time for restarting the y-direction scan will be decreased. In order to reduce the original image on the platen 302 to 1/6.5 and to cause the memory 304 to store it without enlarging the size of the apparatus, the light path as shown may be adopted. In this case, the slit exposure is effected to form an image in the memory while the platen 302 and memory 304 are moved with a velocity difference corresponding to the ratio of reduction. Read-outlamp 403 and detector switches 433-1 and 433-2 are disposed so as not to interfere with the memory movement, as shown in FIG. 8. The memory area may be changed during the write-in time or during the clear time by the pulse motor 409 or the memory may be bit-moved in the x-direction during the read-out time. The number of pulses for driving the pulse motor may determine an extent of the area and bit movements. The forward revolution of the motor causes the memory to move rightward in the direction of the x-axis, and the reverse revolution leftward. Designated by 435 is a support member for supporting the memory and for making the memory movable along a guide rail 436. Denoted by 437 is a pulley for moving the support member 435 by the pulse motor 409. It is also possible to provide the pulse motor with a pinion gear and provide the memory with a rack gear to thereby move the memory in a pinion-rack fashion. Where a disc memory is used, it is parallel-moved to the write-in portion and the read-out portion before the initiation of the respective processes, it is rotated during the clear and segment movement, and it is parallel-bit-moved during the scan write-in and the read-out.

Describing the operation, the original document on the original carriage 302 is illuminated by the light from the exposure light source 303 and a reflected image is formed on the memory by the lens system 503. When the reflected image is formed on the memory with the write-in switch 510 being closed, the resistance in the photoconductive layer is varied in accordance with the light and shade of the original so that the voltage applied to the liquid crystal 407 is varied. Accordingly, the light transmission of the liquid crystal is also varied in accordance with the original image. That is, the information on the original is temporarily stored in the complex memory comprising the liquid crystal and the photoconductive layer. The clearing may be performed by uniformly applying the light from the lamp 403 to the complex memory and closing the switch 511 to apply AC signals from the power source 509 to the memory.

Where the information stored in the memory is to be read out, when the memory is uniformly illuminated by the light source 403, a transmitted image having light and shade corresponding to the information is formed on the photodetector (CCD) 411 by the lens system 410 because the light transmission of the memory differs in accordance with the memory information.

The CCD 411 serially produces a voltage corresponding to the light and shade by its self-scanning. The beam from the laser source 415 is intensity-modulated with that voltage. If a scanning rate in y direction of CCD 411 is equal to that of deflecting mirror 416, the beam may directly be modulated with the outputs of the CCD. If not, the outputs from the CCD may be stored into the buffer memory, from which the outputs are read out in synchronism with the scanning of mirror 416. The controller 309 is a system including a well-known computer, as will further be described, and has registers for setting and counting the page memory number and registers for counting the number of volumes set. These are shown in Table 1 below.

TABLE 1

| Registers | Functions |
|---|---|
| SBC | a register in which the total number of scans in x-direction persegment of CCD is preset |
| SBR | a register for counting the number of scans of CCD in x-direction and for storing such count |
| MAC | a register for counting the number of pages stored in the memory and for storing such count and causing an indicator MACD to indicate that count |
| MAR | a register for counting the number of pages read out from the memory and storing such count |
| CMC | a register for storing the number of volumes set and causing an indicator CMCD to indicate that number |
| CMR | a register for counting the number of volumes and for storing such number |

Figure 5A:
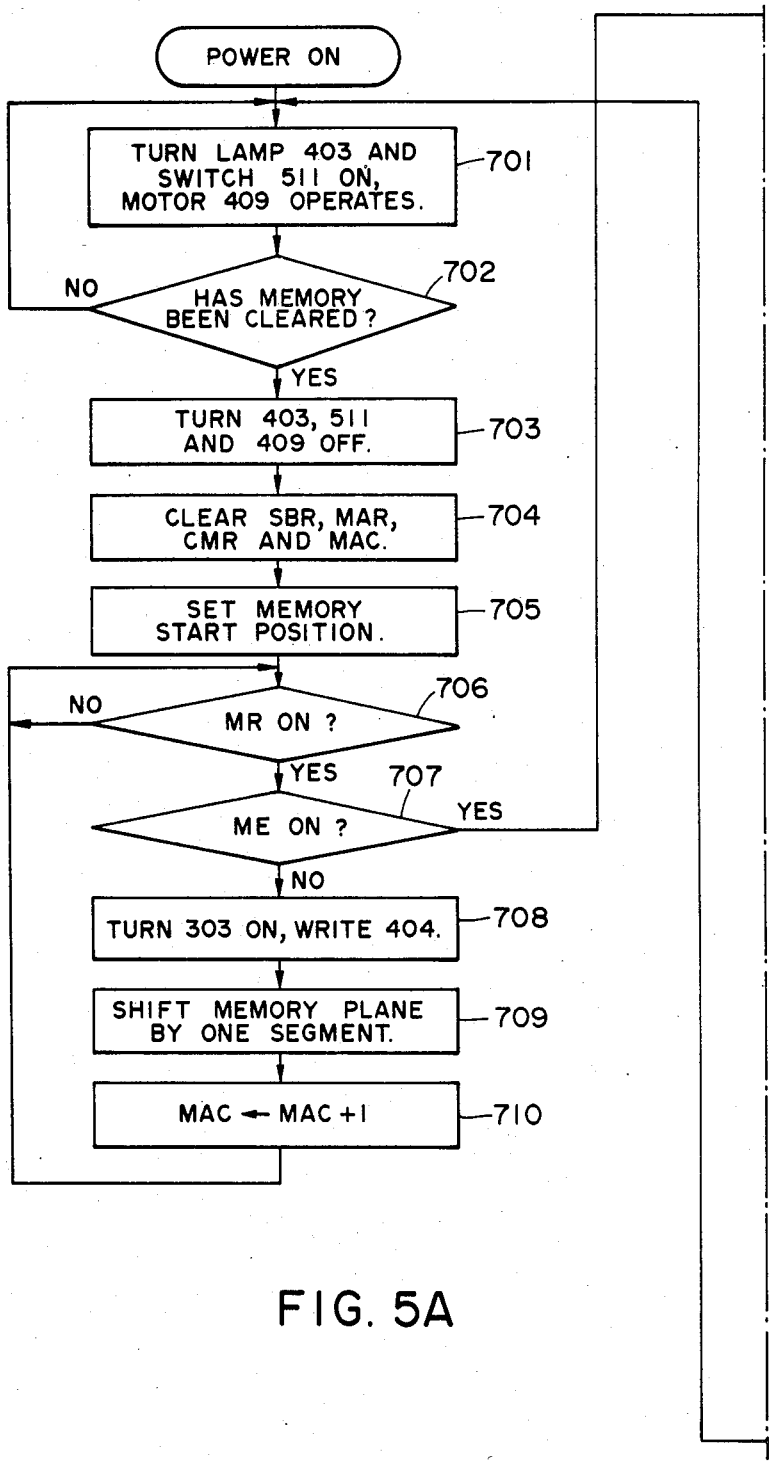
FIGS. 5A and 5B, which are combined as shown in FIG. 5, and FIGS. 13A, 13B and 13C, which are combined as shown in FIG. 13, are control flow charts of the apparatus shown in FIG. 4.
Figure 5B:
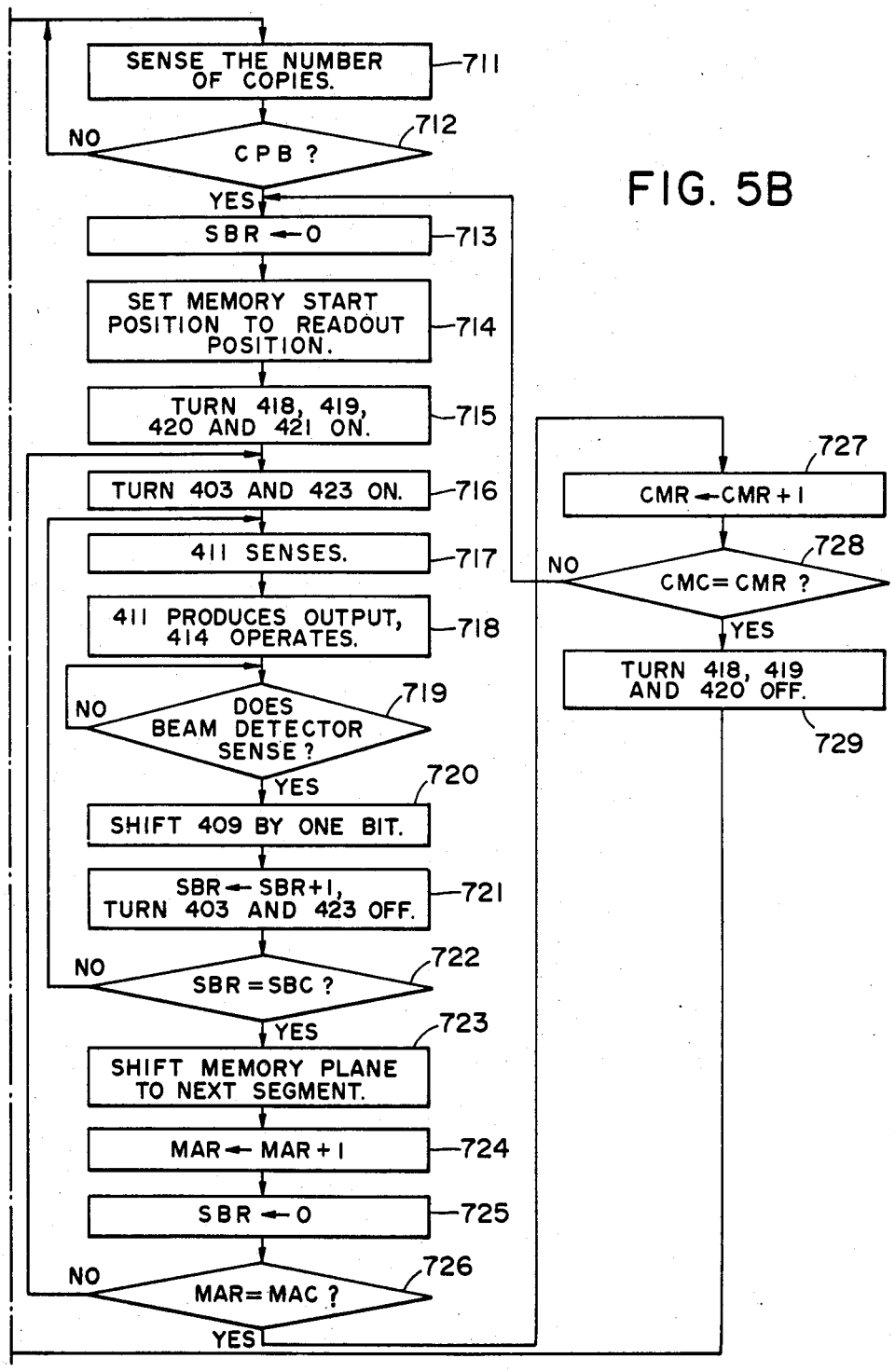

Reference is now had to the sequence control flow chart of FIGS. 5A and 5B to fully describe the control operation effected by the controller 309. After the main switch has been closed and after the heater of the fixing device 426 has reached a predetermined temperature, the switch 511 for the read-out light source 403 and the memory clearing power source 509 is closed and the pulse motor 409 is energized to move the memory while clearing all the content of the memory (step 701). This operation may take place immediately after the closing of the main switch. When the memory has been cleared by moving from end to end, means for clearing is turned off by a memory end detecting switch 433-2 (step 702). After the lamp 403, the power source switch 511 and the motor 409 are rendered to OFF condition upon completion of the memory clear, the scan counting register SBR, the page memory area counting register MAR, the volume number counting register CMR and the indicator driving registers MAC and CMC in the control circuit 413 are all cleared (steps 701–704). Thereafter, the memory is set back to the memory start position (step 705). That is, the pulse motor rotates in a reverse direction until the switch 433-1 senses the start mark. This makes the image memory ready to write in.

When the first page of the original is set on the original carriage 401 and the memory switch MR on the panel is closed, the exposure light source 402 is turned on in the fashion of flash to form the image of the original on the memory. When the power source 508 is operated simultaneously therewith, the image information is recorded on the liquid crystal 407 (step 708). As an alternative method of causing the memory to store the image, the original carriage or the lamp and the optical system lens may be moved to subject the original to the slit exposure. After completion of the storing, the lamp 402 and the power source 508 are rendered to their OFF conditions and the memory plane is shifted right by one segment by the pulse motor 409 and +1 is effected in the storage register MAC. Whether the memory switch has been closed is determined (step 706). In a similar manner, a required number of originals are successively stored in the memory. After each page of the original has been stored, and when the memory end switch ME is closed, the sequence flow advances to step 711, thus making it possible to set other information Here, the number of volumes required is set by the number key CSS and stored in the register CMC.

Read-out and Print

Next, when the start switch CPB is closed (step 712), read-out of the memory and recording operation are started.

The y-axis direction of the memory is read by CCD 411 through the self-scanning effected by external clock pulse (not shown) of CCD 411. The x-axis direction is scanned by the movement of the memory plate driven by the pulse motor 409 and read by one bit of CCD 411. In brief, reading of one line is effected by CCD 411. Also, the end of each segment of the memory may be optically detected by a position detecting hole (not shown) provided in the memory and accurately adjusted in position.

When the reading and recording are started, the page register SBR is first reset to zero. Then, the end of the memory area 1 is set to the read-out position (step 714). This is accomplished by further providing a light switch in the read-out portion to energize the motor until the mark 434-1 is sensed. At this time, the chargers 418, 419, the lamp 420 and the developing device 421 operate to initiate the execution of the known electrophotographic process (step 715). After the surface of the photosensitive medium charged by the charger 418 has passed by the surface of the charger 418, the memory read-out light source 403 is turned on to effect the first scanning in the y-axis direction. The pick-up roller 423 is also operated to feed a sheet of transfer paper (step 716). The image I5 formed on the CCD 411 is taken into the CCD memory (step 717), and the CCD is caused to scan in the y-direction in synchronism with the operation of the laser scanner 414 for effecting the scanning in the widthwise direction of the photosensitive medium (from left to right)(step 718).

The time-serial electrical signals so taken in are applied from the CCD through an amplifier 412 to a semiconductor laser 415 and the intensity of the laser is modulated with the magnitude of the taken-in signals.

The laser light carrying the image information is deflected in synchronism with the y-direction scanning of the CCD and applied to the surface of the rotating photosensitive drum through the F-$\theta$ lens. When the first scanning in the y-axis direction is terminated, the laser beam is caused to be incident on a fixed beam detector provided at the end of the width of the photosensitive drum surface. By the detection of such incident light, the y-axis scanning of the CCD is ceased and changed over to the next y-axis scanning (step 719). Thus, when the detector effects its detecting operation, the pulse motor 409 is driven by one step and the memory shifts by one bit in the x-axis direction (step 720). Then, the contents of the register SBR are incremented by one, and the lamp 403 and the paper feed roller 423 are rendered to their OFF conditions (step 721 Incidentally, the register SBC pre-stores the number of scannings i.e. resolution) in the x-axis direction for one segment of the memory. For example, the scanning number is 2970 in the case of an A4 size sheet. Therefore, when the number in the register SBC is coincident with the previous number in the register SBR, the scanning for one segment is completed (step 722). Since only one bit shift has been effected, the sequences return to step 717 and the scanning in the y-axis direction starts again from the initial position, and the information on the image formed on the CCD 411 is taken into the CCD 411 and the information on the second line is likewise recorded on the photosensitive drum in synchronism with the laser scanner 414. Such operation is repeated until the maximum number of scannings determined by the register SBC is completed, whereupon the step progresses to the next page read-out print step.

On the other hand, the photosensitive drum 400 is exposed to the laser beam simultaneously with the AC charging by the charger 419 and the whole of the exposed surface thereof is illuminated by the lamp 420 to form thereon an electrostatic latent image of high contrast. This latent image is developed into a visible image with the toner of the developing device 421. The developed image is transferred onto recording paper 422 by the charger 424, the recording paper 422 being fed by the roller 423, whereafter the recording paper having the transferred image is fixed by the fixing device 426 and discharged into the tray 427. Thus, a single-sheet copy of the first page of the first volume has been obtained.

Subsequently, the step motor 409 operates to shift the memory plate and the memory segment is moved to the memory read-out portion (step 723). Then, the contents of the register MAR are incremented by one (step 724), and the aforementioned x-axis direction scanning count register SBR is reset to zero (step 725). Each time the read-out of one area is terminated, the count register MAR and the memory register MAC are compared with each other (step 726) and when they are not coincident, namely, when the recording of the whole memory has not been completed, the next memory segment is read out (step 716). In the same manner as the first page, the recording of the second page is completed through the feeding of the recording paper, the memory read-out and the latent image formation. Likewise, thereafter, the recording of the number of pages stored in the indicator register MAC is continued to thereby complete the recording of one volume. At this time, the tray signal TD may be produced to slide the tray as aforesaid to form an end to the volume.

The memory movement by the pulse motor and the rotation of the photosensitive drum 400 are in synchronism with each other. That is, the drum and the pulse motor are in synchronism with each other so that the time required from after the laser beam has effected one line scan until it initiates the next one line scan is equal to the time required to move the memory by one bit in the x-direction.

Thereafter, an increment is effected in the volume number counting register CMR (step 727). The desired number of volumes is stored in the memory CMC which causes the number indicator CMCD to indicate the number, so whether or not the number is coincident with the number stored in the counter register CMR is judged (step 728). When they are not coincident, the step 713 is executed to reverse motor 409 to return the image memory to its initial position (step 714), and the read-out from the memory area 1 is again effected to continue the recording. Likewise, thereafter, the recording operation is effected for the required number of volumes set by the indicator CMCD, whereafter the operation is stopped (step 729). At this time, the image information stored in the memory is also cleared (step 701). In the present embodiment, in the tray 308, the printing is effected in the order from the bottom page or the initially read-out page, whereas the order of pages may be reversed if the read-out from the memory is reversed, namely, if the read-out and printing is effected in the order from the last page.

While description has been made with respect to an example in which a light memory is used as the image memory, it will be apparent that the use of a memory medium such as semiconductor memory, magnetic disc or magnetic tape also leads to the same effect as that described above.

Description has also been made with the electrophotographic method as an example of the recording system, but the use of the ink jet printer system in which an ink gun is controlled by the outputs from the CCD to print, the contrography system or the electrostatic recording system will lead to the same effect as that described above.

Also, the above-described control flow may be implemented by those skilled in the art by using a well-known computer system as the controller 309 and by the use of the program thereof, for example, the microcomputer system ($\mu$ COM4, etc.) and therefore, the details thereof need not be described.

Figure 11:
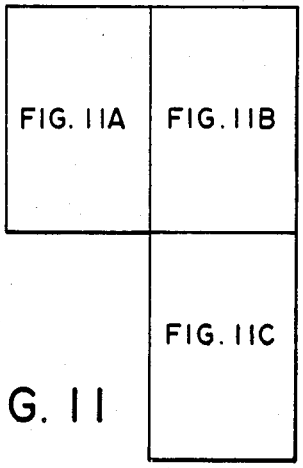
FIGS. 11A, 11B and 11C, which are combined as shown in FIG. 11, is another control flow chart.
Figure 11A:
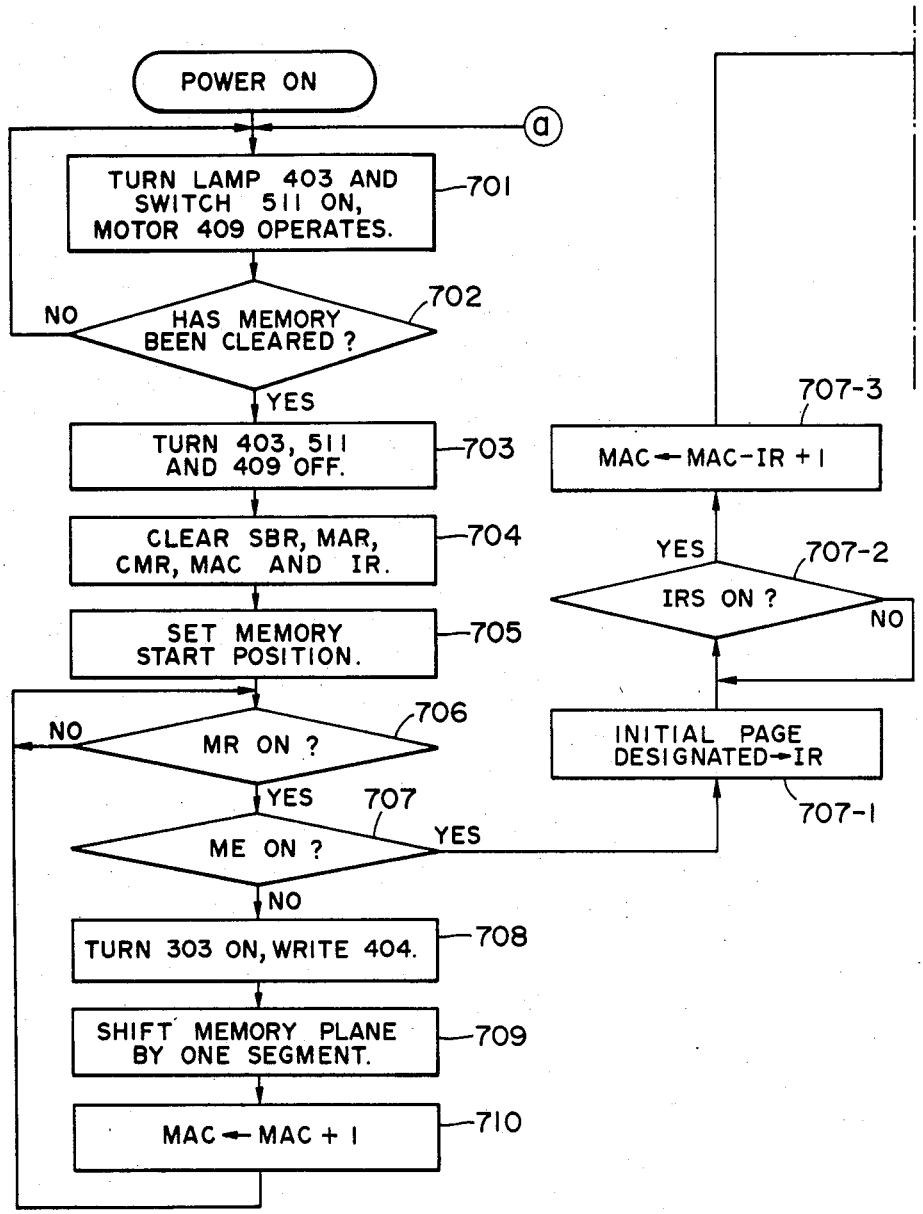
Figure 11B:
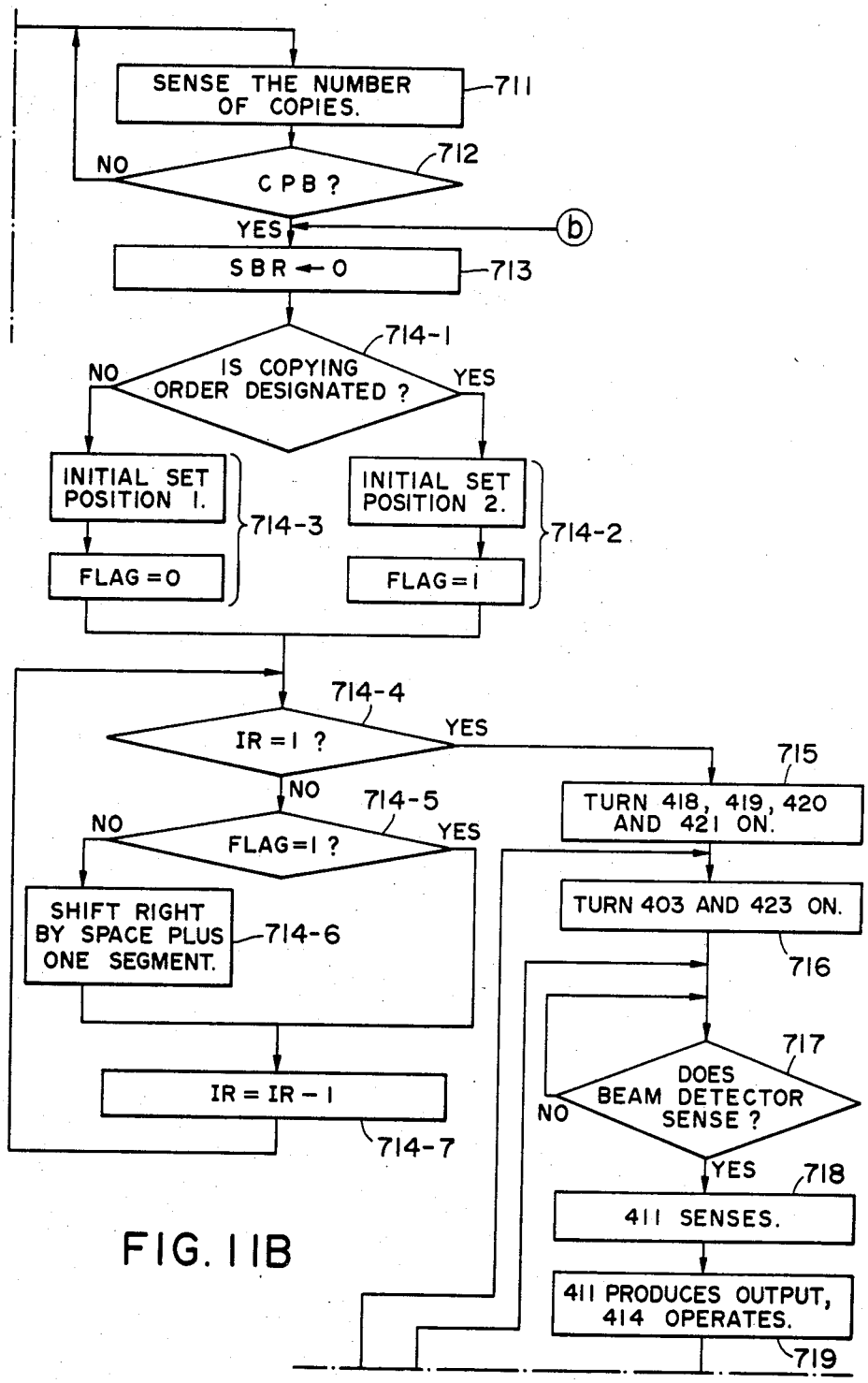
Figure 11C:
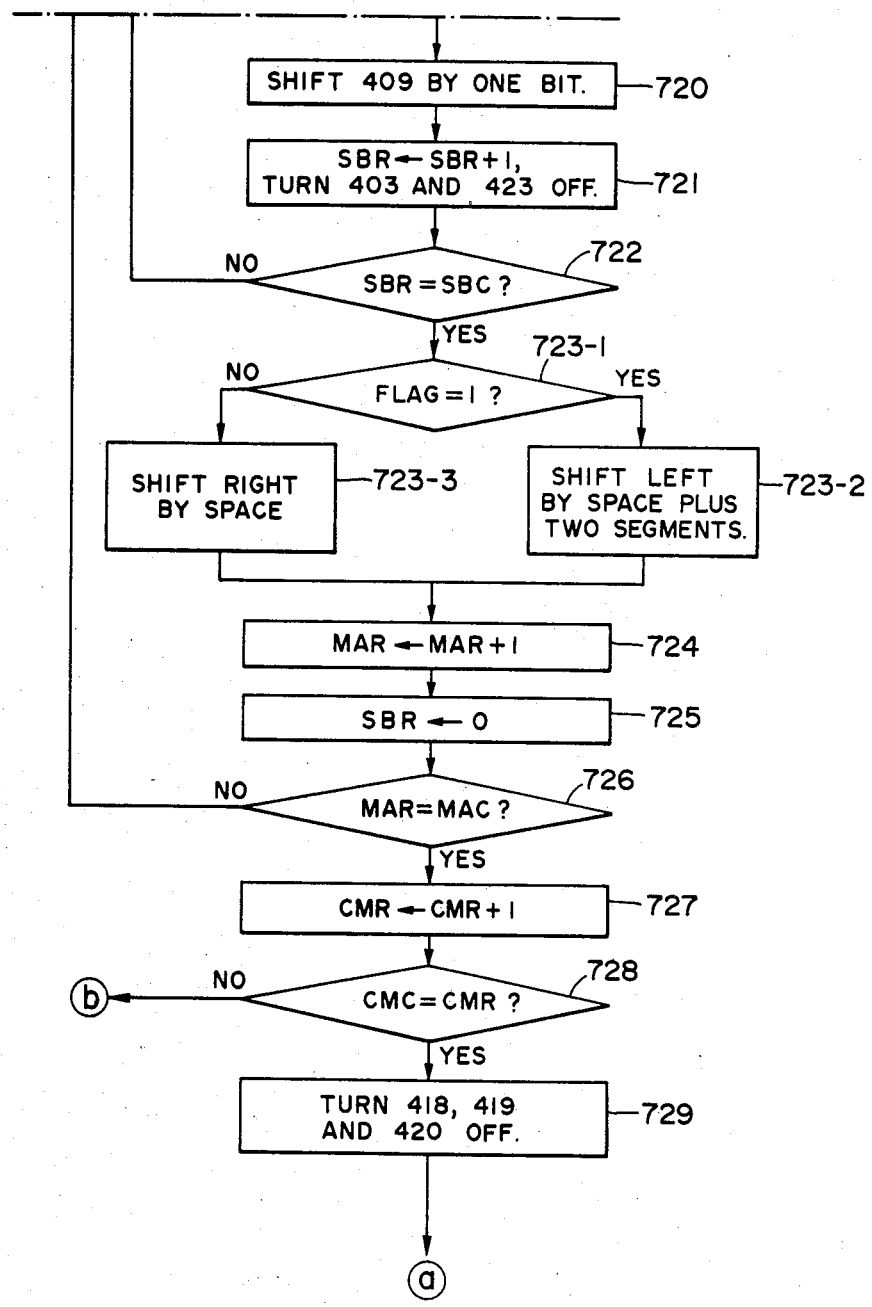

FIGS. 11A, 11B and 11C are a control flow chartg in which memory read-out and print is effected reversely from the order of memorization to produce copies of a desired number of volumes, or read-out and print is effected in the order from any memory area to produce copies of a desired number of volumes. A switch F/R for selecting the forward and the reverse and a switch IR for designating any memory area are provided on the panel 301. When memorization of the original image in the memory is completed in the manner described previously (step 707), the ten-key array CSS is closed to enter the area number into the register IR (step 707-1). Whether or not the switch IR has been closed is determined (step 707-2). When the switch IR has been closed, the register MAC is reset as shown in step 707-3. Whether or not the print button CPB has been depressed is judged (step 712), and whether or not the switch F/R has been closed is decided (step 714-1). When these are in their ON conditions, the pulse motor is operated to set the memorization end position is set to the read-out position and a reverse flag is set to another memory. When the print button and the switch F/R are in their OFF conditions, the memory start position is set to the read-out position in the manner as shown in step 714 of FIG. 5 (step 714-3). When the number in the register IR is 1, the step progresses to step 715 as shown in FIG. 5 (step 714-4) starting the read-out and print from the first. When read-out of one page is terminated, the foward or the reverse is judged in step 722-1 (step 723-1). When the reverse is determined, the memory is moved leftward by two segments by the pulse motor, and when the forward is judged, the memory is moved rightward by one segment (step 723-2,3). Thereafter in the manner as shown in FIG. 5, the reverse read-out and copy of one volume is executed and this is repeated to complete copying of a desired number of volumes set by the ten-key.

Assuming that copying is to be effected from the second page, the number "2" is initially preset in the register IR (step 707-1). Then, the contents of the page register MAC are decremented by one (step 707-3). When it is judged in step 714-1 that the number in the register IR is not "1", the forward or the reverse is determined (step 714-5). When the forward is judged, the memory is moved rightward by one segment (step 714-6), and a decrement is effected in the register IR (step 714-6), Then, the number in the register IR becomes "1", so that the step progresses to step 715, thus initiating the read-out and print from the second page. When the reverse is judged, the memory is not moved but the number in the register IR is rendered to "1". Thus, the read-out and print is initiated from the last page. Since the number in the register MAC is corrected in accordance with the number in the register IR, copying is effected from the second page to the last page when in the forward direction, and copying is effected from the last page to the second page when in the reverse direction. That is, in any case, copies of a desired number of pages may be obtained.

What is called the segment shift in FIGS. 4 and 10 is the movement of the memory over a length including the space between segments, and it can be executed by counting the power source pulses of the pulse motor in the control unit 309 and deenergizing the motor. One segment movement is made possible by $2970+\alpha$ count. This is accomplished by storing in advance a necessary number in a read-only memory (ROM) or a random-access memory (RAM) so as to cause control 309 to produce the stored number of pulses. Alternatively, it is also accomplished by sensing driving pulses, which are counted in the computer by the number stored. The above technique may also be applied to the one-bit movement of the memory, and to an image memory setting with a predetermined number of pulses stored in an ROM or RAM.

Figure 12:
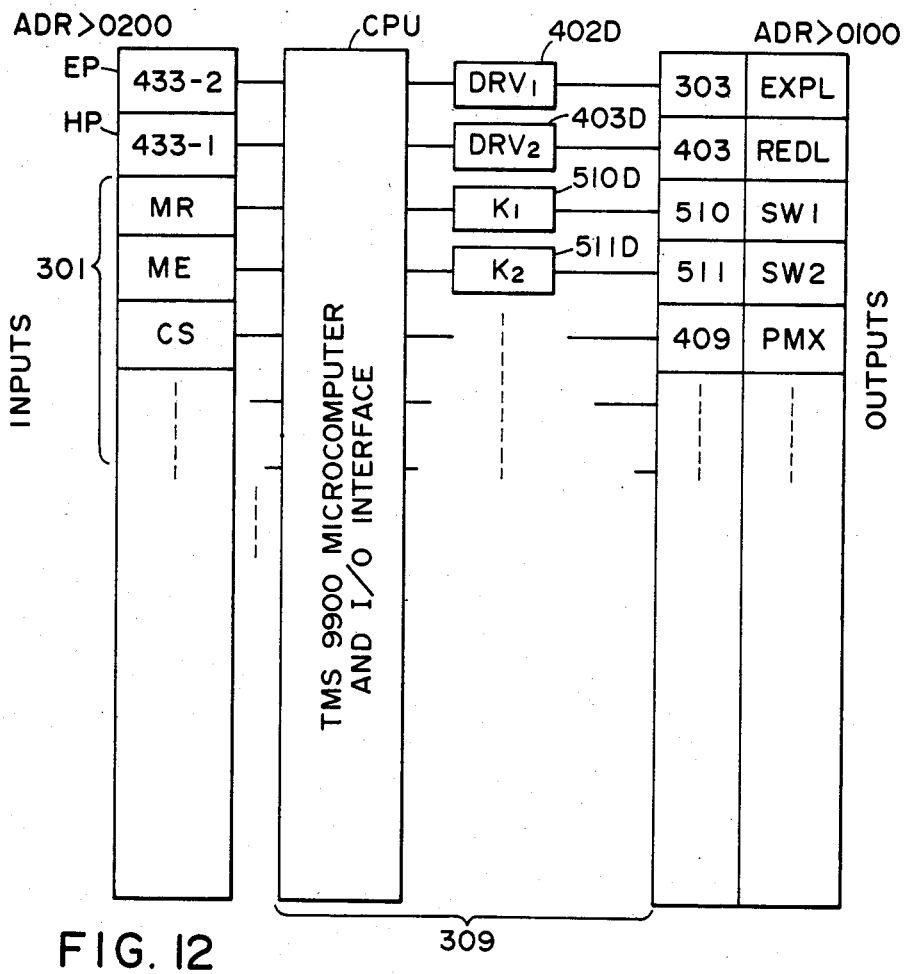
FIG. 12 is a main control circuit diagram.

FIG. 12 shows an example of the circuit using the system of microcomputer TMS 9900 (Texas Instruments Inc.) as the controller 309 of FIG. 4. Designated by 402, 403, 510, 511, etc. are output loads as in FIG. 4, and denoted by 402D and 403D are well-known driver circuits for turning on the lamp. Designated by 510D and 511D are relays for closing and opening the switches. Through such drivers, each load is connected to the ouput port of CPU. Pulse motor 409 has input connnections connected to ON and OFF signal lines from the CPU and the forward and reverse rotation signal lines.

Figure 13:
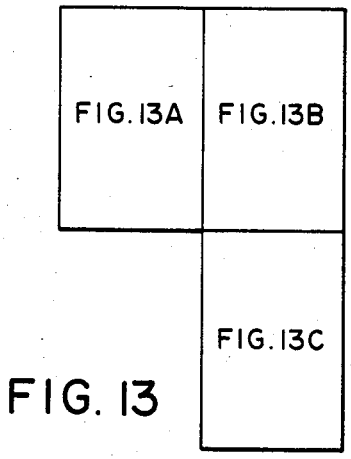
Figure 13A:
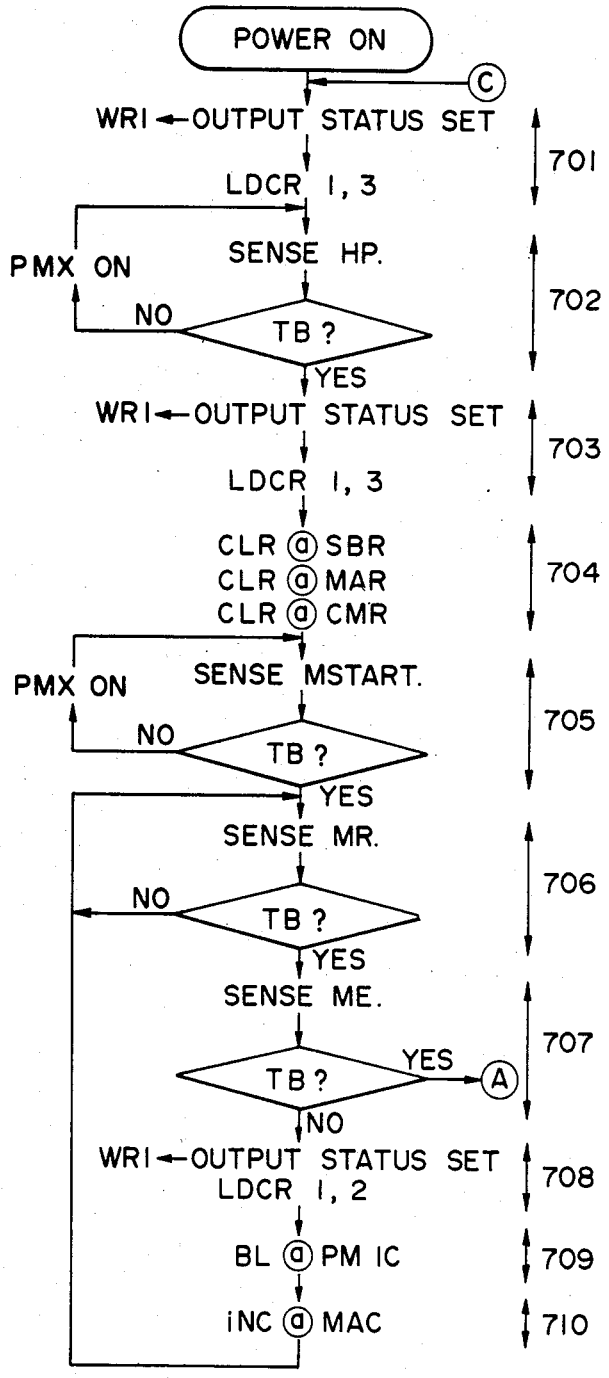
Figure 13B:
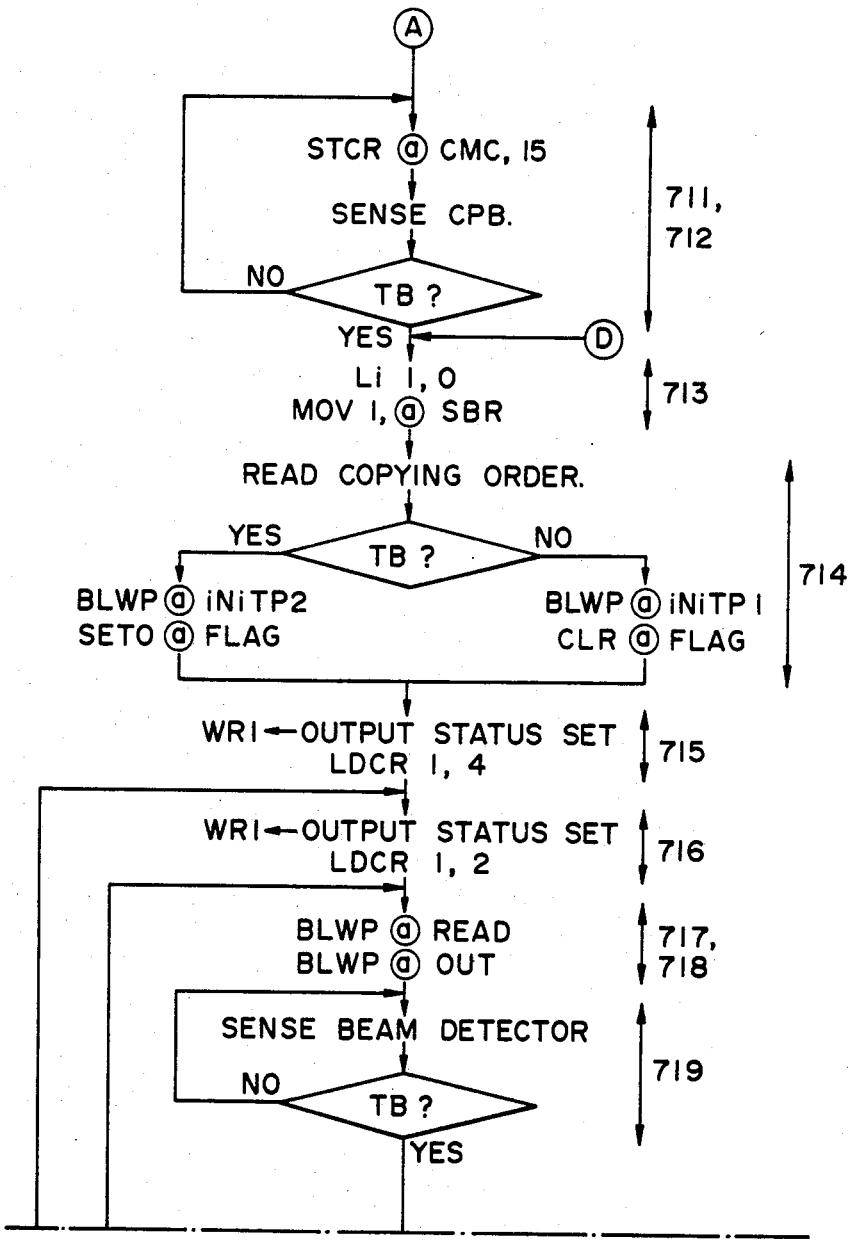
Figure 13C:
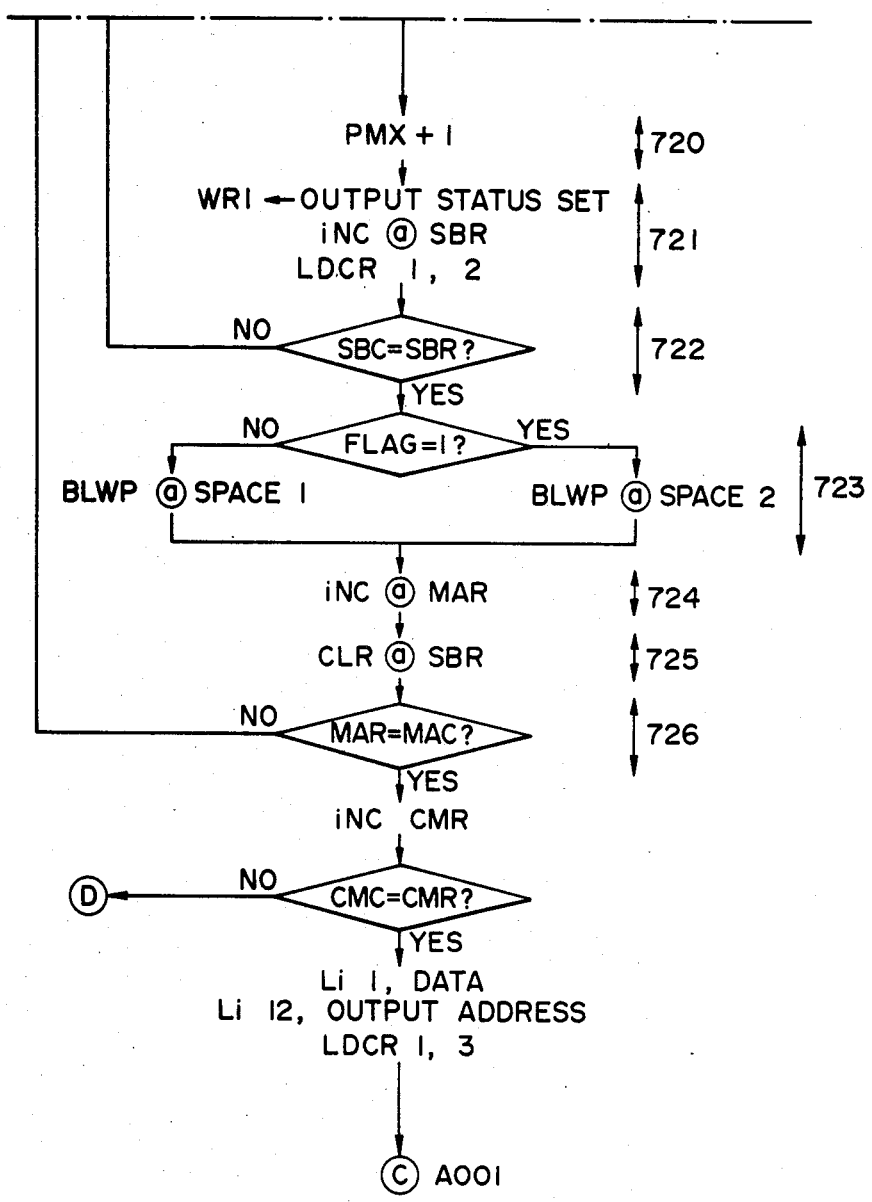

FIG. 13 is a flow chart showing, on a machine word level, example of the program sequences when the control in FIG. 4 is achieved by the use of TMS9900. The microcomputer system usually includes a memory ROM for storing the program sequences written in machine words and a memory RAM for taking in and out the data when this program is executed, and the program shown in FIGS. 4 and 13 is written into the ROM while the RAM is used as the various registers MAR, MAC, etc. The instruction words LDCR, etc. in FIG. 13 are in accordance with the product manual of TMS9900. Designated by BL and BLWP are programs which skip to subroutines, and the operation of reading the memory content into the CCD as in steps 717 and 718 and the operation of putting out such memory contents are executed in subroutines. The contents of these subroutines could be easily prepared by those skilled in the art.

An example of the actual program is shown in Table 2 below in instruction list. Programs can be prepared in this manner. The input port address is the address from 0200H (hexadecimal) and the output port address is the address from 0100H.

TABLE 2

```
Power Source ON
      ↓
A001 Li  1, > 000A        ↑
     Li 12, > 0100        ↑
     LDCR 1, 15           ↑
      ↓                  701
     BLWP @ PMX1           ↓
      ↓                    ↓
     Li 12, > 0200         ↓
       TB O                ↓
                           ↑
     JNE A001              ↑        702
       Li 1, O             ↑
     Li 12, > 0100         ↓        703
     LDCR  1, 15
     CLR @ SBR             ↑
     CLR @ MAR             ↑
                           ↑        704
     CLR @ CMR             ↓
     CLR @ MAC             ↓
      ↓                    ↑
A002 BLWP @ PMX1           ↓
      ↓                    ↓        705
     Li 12, > 0200         ↓
       TB 1                ↓
                           ↓
     JNE A002
      ↓                    ↑
     A003  TB 2            ↑        706
     JNE A003              ↓
      ↓
      .
      .
      .
```

Likewise, the control flow of FIGS. 11A, 11B and 11C may be program-coded.

Thus, according to the present invention, a plurality of pages of originals are once stored in the image memory, and then they are converted into electrical signals and further into light signals, whereby a volume is recorded, and by repeating this, a plurality of volumes of copies may be obtained. Therefore, the originals required should only be pre-stored by the image memory. Accordingly, except for the trouble of prememorization, a plurality of volumes of copies having pages well arranged may be obtained completely automatically, thus saving the labor of the operator. Also, the sorter for arranging pages may be eliminated to make the entire apparatus more compact. Further, a plurality of original documents or articles of any shape may be automatically duplicated at high speed. In addition, if an optical memory such as liquid crystal is used as the memory, the half-toner or gray scale between light and shade may be simply stored to enable repetitive faithful reproduction of original images and this can be accomplished quite economically.

Further, where recording is to be effected by the use of an electrophotographic copying machine, the operator must wait for the copying until the fixing device or the like reaches a predetermined temperature after an actuation of the main switch of the copying machine, but in the meantime the information on the originals can be stored in the memory, thus shortening the time required for the copying.

What we claim is:

1. An image forming apparatus for forming images from an image material which stores a plurality of page images to be formed, comprising:

means for irradiating light onto the image material, said irradiating means being disposed on one side of said image material;

a line-configured image photosensing means disposed on the other side of said image material to sense a transmission light from said irradiating means, wherein said image photosensing means reads line image of one of said page images, converts the reading image of each line into electrical signals, and outputs the converted electrical signals in a serial form of a number of pixel data entries for each line;

driving means for providing relative movement between said image material and said photocopying means to perform scanning of the material, so that all line images of a page image on said image material are derived as said electrical signals in a serial form; and means for controlling said driving means to start the operation in accordance with a signal representing the position of said image material.

2. An image forming apparatus for forming images from an image material, comprising:

means for irradiating light onto the image material;

a line-configured photosensing means having a line length approximately the same as the width of a page image on said image material, wherein said photosensing means reads line images of one of said page images, converts them into electrical signals, and outputs the converted electrical signals in a serial form of a number of pixel data entries for each line;

an optical element array disposed between said image material and said photosensing means such that a line of the page image in said image material is introduced into said photosensing means, said optical element array having a width substantially the same as the image width of a page of said image material;

driving means for providing a relative movement between said image material and said optical element array so that all line images of a page image on said image material are derived as the electrical signals in a serial form; and means for controlling said driving means to provide said relative movement in a predetermined amount.

3. An image forming apparatus for forming images from an image material, comprising:

means for irradiating light on said image material;

a line-configured photosensing means for reading line images from the image material, for converting the image readings into electrical signals, and for outputting the converted electrical signals in a serial form;

driving means for providing a relative movement between the image material and said light irradiating means at a predetermined speed to perform scanning for said image material, so that all image in the image material are derived as the electrical signals in a serial form of a number of pixel data entries for each line;

register means for storing the number of lines corresponding to the images to be copied from the image material;

means for counting the number of lines read by said photosensing means in the scanning operation; and means for controlling said driving means to stop the scanning operation when said counting means counts the number stored in said register means.

4. An apparatus according to claim 1, 2, or 3, wherein said image material includes a marker, and said controlling means controls said driving means to start the scanning operation after detection of said marker.

5. An apparatus according to claim 1, 2 or 3, further comprising means for printing an image based on the pixel data, and additional control means for controlling the reading out of images on a line in synchronism with the printing operation of said printing means.

6. An apparatus according to claim 5, wherein said printing means includes means for sensing a laser beam, and said additional control means performs the reading out control in synchronism with the beam detection by said beam sensing means.

* * * * *

UNITED STATES PATENT AND TRADEMARK OFFICE

CERTIFICATE OF CORRECTION

PATENT NO. : 4,659,210

DATED : April 21, 1987

INVENTOR(S) : SUSUMU SUGIURA, ET AL.

It is certified that error appears in the above-identified patent and that said Letters Patent is hereby corrected as shown below:

COLUMN 5

Line 22, "discharge" should read --discharged--.
Line 50, "solid state" should read --solid-state--.

COLUMN 6

Line 12, "afore-mentioned" should read --aforementioned--.
Line 40, "Read-outlamp" should read --Read-out lamp--.

COLUMN 7

Line 37, "persegment" should read --per segment--.

COLUMN 8

Line 59, "I5" should be deleted.

COLUMN 9

Line 9, "is ceased" should read --ceases--.
Line 16, "721 Inciden-" should read --721). Inciden- --.
Line 18, "nings i.e." should read --nings (i.e.--

COLUMN 10

Line 49, "chartg" should read --chart--.

COLUMN 11

Line 13, "Thereafter in" should read --Thereafter, in--.
Line 54, "setting" should read --position setting--.

UNITED STATES PATENT AND TRADEMARK OFFICE

CERTIFICATE OF CORRECTION

PATENT NO. : 4,659,210

DATED : April 21, 1987

INVENTOR(S) : SUSUMU SUGIURA, ET AL.

It is certified that error appears in the above-identified patent and that said Letters Patent is hereby corrected as shown below:

COLUMN 12

Line 2, "level, example" should read --level, an example--.

COLUMN 13

Line 28, "image" should read --images--.

COLUMN 14

Line 26, "all image" should read --all images--.

Signed and Sealed this

Twenty-third Day of February, 1988

*Attest:*

DONALD J. QUIGG

*Attesting Officer*

*Commissioner of Patents and Trademarks*